United States Patent [19]

Fois

[11] 4,104,898

[45] Aug. 8, 1978

[54] LOCK SAFETY DEVICE

[76] Inventor: Battista Fois, via Roccella Ionica 48, Rome, Italy

[21] Appl. No.: 774,966

[22] Filed: Mar. 7, 1977

[30] Foreign Application Priority Data

Mar. 9, 1976 [IT] Italy ..... 20986 A/76

[51] Int. Cl.[2] ..... E05B 15/08; E05B 17/14

[52] U.S. Cl. ..... 70/419; 70/423; 70/454; 70/455

[58] Field of Search ..... 70/363, 364 A, 372, 70/375, 386, 416, 417, 419, 420, 423, 454, 455

[56] References Cited

U.S. PATENT DOCUMENTS

| | | | |
|---|---|---|---|
| 828,961 | 8/1906 | Owens | 70/419 |
| 2,101,779 | 12/1937 | Kenney | 70/419 |
| 2,199,165 | 4/1940 | Smith | 70/419 |

*Primary Examiner*—Robert L. Wolfe
*Attorney, Agent, or Firm*—McGlew and Tuttle

[57] ABSTRACT

The safety device comprises a rotatable lock-operating rotor having a first key slot extending transversely thereof, a non-rotatable inner cylindrical body adapted for fixed securement to a door or the like, and a hollow cylinder embracing the rotor and the cylindrical body and having its inner end fixedly secured to the cylindrical body or member. Key-operable pins, plungers or pistons interconnect the rotor and the fixed cylindrical body to prevent rotation of the rotor. The rotor is formed with a first key slot extending transversely thereof and the hollow cylinder has a closed outer end formed with a second key slot extending transversely thereof. A rotatable diaphragm member is interposed between the fixed outer end of the hollow cylinder and the rotor, and has a third key slot extending transversely thereof. The rotor may be disconnected from the fixed cylindrical member by a key inserted into the first slot to engage the pins, plungers or pistons. The second slot in the fixed outer end of the hollow cylinder is normally angularly aligned with the third slot in the rotatable diaphragm, and the second and third slots extend at an angle, such as 90°, to the first key slot in the rotor to block access to the pins, plungers, or pistons. The key has a stem with a transverse bar on its inner end.

5 Claims, 2 Drawing Figures

LOCK SAFETY DEVICE

FIELD AND BACKGROUND OF THE INVENTION

The present invention relates to a safety device for locks which utilizes a rotatable diaphragm interposed between the key opening and the operating portion of the lock.

There are presently known many types of so-called 'safety' locks which in effect are not so inasmuch as the operating portion of the lock is easily accessible from the outside through the opening in which the key is inserted. It is for this reason that the so-called 'safety' locks can be easily opened from the outside by the use of lock picks and other commonly-known burglar tools.

SUMMARY OF THE INVENTION

To eliminate these particular problems and to provide locks which are truly 'safety' locks, the present invention provides a rotatable diaphragm which is interposed between the key opening and the operating section of the lock, this rotatable diaphragm being acted upon by means of the key itself, when the key is partially inserted in the key opening, in a way such that it is impossible to arrive at the tumbler pins or other operating means of the lock by the use of lock picks or other types of burglar tools through the key opening.

BRIEF DESCRIPTION OF THE DRAWINGS

The present invention will be better understood from the following detailed description, supplied in a pure indicative and not limitative way, and with particular reference to the attached drawings in which.

DESCRIPTION OF THE PREFERRED EMBODIMENT

Figure 1:
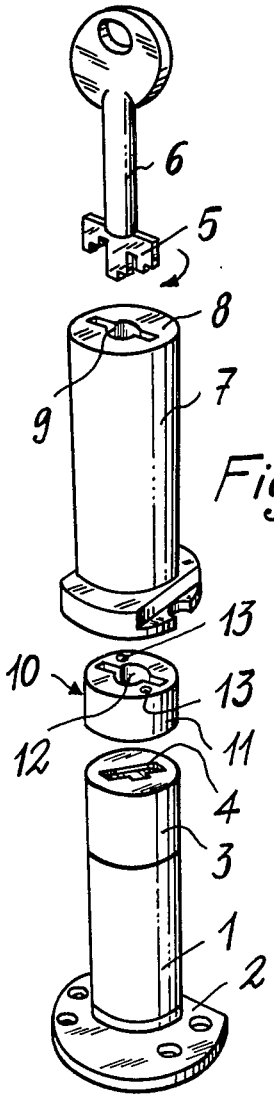
FIG. 1 shows in an enlarged perspective view the device of the present invention as applied to a lock of the head cylinder type.
Figure 2:
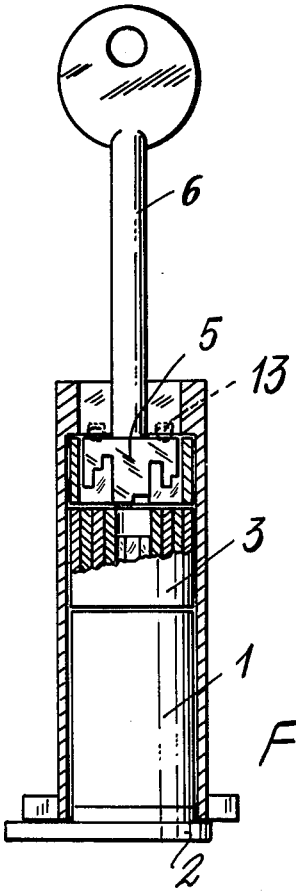
FIG. 2 shows in sectional view the lock, equipped with the device of the present invention, in an assembled position.

A typical lock of the head cylinder type is substantially composed of a cylindrical body 1 integral with a terminal flange 2 for fixing the lock to the door body and by a rotor 3 provided at its outer end with a slot 4 through which the end 5 of the key 6 is inserted. On the inside, between the fixed body 1 and the rotor 3, there are located the conventional spring-actuated tumblers or pistons.

The assembly of the body 1 and of the rotor 3 is contained in a hollow cylinder 7 closed at one extremity by a plate 8 having an opening 9 therein which permits the entrance of the end 5 and of the stem 6 of the key, cylinder 7 being attached by conventional means to flange 2 and/or to fixed body 1.

The conventional mode of operation of such a lock is known and may be briefly described as follows: the key 6 is introduced through the opening 9 of the hollow cylinder 7 and the end or head 5 can freely enter into the slot 4 of the rotor 3, in a manner such that each tooth of the head 5 pushes, in operating contact with the individual springs, the operating pistons or tumblers located between the rotor 3 and the fixed body 1, bringing them to the level of the plane of separation between the rotor 3 and the body 1. In so doing it is possible to effect the rotation of rotor 3 with respect to body 1 thus also effecting the rotation of the command stem of the lock. It is also evident that, inasmuch as the opening 4 of rotor 3 remains aligned with the fixed opening 9 of hollow cylinder 7, the pistons located on the inside of rotor 3 are easily accessible from the outside. It is therefore possible to actuate said pistons or tumblers from the outside by the use of these lock picks or other burglar tools, in the same manner in which operates the end or head 5 of the key.

The safety device of the present invention provides essentially the interposition of a diaphragm, indicated in its whole as 10, substantially consisting of a small cylinder 11 positioned between the rotor 3 and the plate 8 of the hollow cylinder 7. Such rotatable diaphragm has preferably a width or diameter corresponding to the transverse length of the key head 5 and consequently it is necessary to increase by the same amount also the interior dimension of the hollow cylinder 7. The rotatable diaphragm 11 is provided with an opening 12, corresponding exactly, in plan view, to that of the opening 9, which extends through the entire width of diaphragm 11.

According to the invention, there may be also provided spherical bearings 13, spring-biased, capable of engaging, in at least two positions at right angles with respect to each other, suitable seats provided on interior face of plate 8, these bearings assuring at least two fixed positions at which, respectively, the opening 12 coincides with the opening 9 or with the slot 4 of the rotor 3.

The operation of the device of the present invention can be briefly summarized as follows: the lock is mounted with the parts thereof in a position whereby they may rotate exactly with respect to each other as indicated in FIG. 1. In particular, above the standard fixed body 1 and the rotor 3, there is located the rotatable safety diaphragm 10 in a way such that the key opening slot 12 extends at a right angle with respect to the opening 4 of the rotor. The assembly is then positioned and fixed with respect to hollow cylinder 7 in a manner such that the opening 12 coincides angularly with the opening 9 of the plate 8. The key is inserted through the opening until the head 5 engages completely the rotatable diaphragm 12 (the key cannot proceed any further since the head 5 is at a right angle with respect to the opening 4 of the rotor).

Following this, the key is rotated through 90°, such rotation moving the rotatable diaphragm 10 to a position where opening 12 corresponds to opening 4 of the rotor. The key can then be inserted further into the body of the lock, in a manner that the head 5 enters through the opening 4 and activates the pistons or tumblers to rotate the rotor 3 with respect to fixed body 1, so as to activate the main stem of the lock.

It is evident from the preceding description that, in a rest position, it is impossible to contact from the outside, without the correct key, the pistons or tumblers located between the rotor 3 and the fixed body 1, inasmuch as the aligned openings 9 of the hollow cylinder 7 and 12 of the diaphragm 10 are at a right angle with respect to opening 4 of rotor 3. It is to be noted as a particular characteristic of the present invention that the rotatable diaphragm not only prevents the opening of the lock by means of lock picks or similar devices but also avoids the possibility that imprints be made for the purpose of manufacturing false keys.

It is to be finally noted that, even if the diaphragm is made to rotate by any illegal means and the rotatable diaphragm 10, through the opening 9 of the hollow cylinder 7, is made to be positioned with its opening 12 aligned with opening 4 of the rotor 3, one still does not have access to the interior of the lock since the opening 9 is always at right angle to the opening 4.

It is also to be considered that the use of the safety diaphragm 10 does not complicate in any way the opening and closing operation of the lock and this is particularly due to provision of positioning means 13 and to the other means already known in the art, such as automatic spring-driven means for the partial expulsion of the key, off-centered keys, or similar means.

The invention has been particularly described with reference to a barrel or cylinder lock but it is evident that it automatically extends to any other type of combination locks, both to those in which the pistons or tumblers are oriented parallel to the key axis and to those in which the pistons or tumblers are oriented perpendicular to the key axis. Variations to be made to the object of the present invention to apply to various types of locks should be evident to those skilled in the art in the light of the present disclosure.

While only one embodiment of the invention has been described, it should be now possible to one skilled in the field to arrive at numerous variations and changes in connection therewith, which variations and changes should be considered as falling within the scope of the present invention.

What I claim is:

1. A lock safety device comprising, in combination, a rotatable lock-operating rotor having a first key slot extending transversely thereof, a non-rotatable inner member adapted for fixed securement to a door or the like; key-operable pin means interconnecting said rotor and said inner member to prevent rotation of said rotor, said pin means being operable, by a key engaged in said first key slot, to release said rotor for rotation, relative to said inner member, by the thus engaged key; a fixed outer member having a second key slot extending transversely thereof; and a rotatable diaphragm member interposed between said fixed outer member and said rotor and having a third key slot extending transversely thereof; said second and third slots normally being angularly aligned with each other and extending at an angle to said first key slot to block access to said pin members through said first key slot; said diaphragm member, upon insertion of a key through said second key slot into said third key slot, then aligned with said second key slot, being rotatable to align said third key slot with said first key slot for further insertion of the key into said first key slot to operate said pin means to release said rotor for rotation of said lock-operating rotor by the key.

2. A lock safety device, as claimed in claim 1, in which said second and third key slots normally extend perpendicularly to said first key slot.

3. A lock safety device, as claimed in claim 1, including means releasably retaining said rotor in a first angular position in which said third slot is aligned with said second slot and in a second angular position in which said third slot is aligned with said first slot.

4. A lock safety device, as claimed in claim 1, in which said non-rotatable inner member is a cylindrical body fixed against rotation and having a flange on its inner end; a hollow cylinder telescoped over said rotor and said cylindrical body and secured to said flange, said hollow cylinder having an outer end formed with said second slot; said rotatable diaphragm member comprising a cylindrical member interposed between said outer end of said hollow cylinder and said rotor.

5. A lock safety device, as claimed in claim 1, in which said key includes a stem having a head extending transversely of an inner end thereof and engageable in said slots; said stem, when said head is engaged in said third slot in said diaphragm member and in said first slot in said rotor, extending through said second slot.

* * * * *